US007708877B2

(12) United States Patent
Farshid et al.

(10) Patent No.: US 7,708,877 B2
(45) Date of Patent: May 4, 2010

(54) INTEGRATED HEAVY OIL UPGRADING PROCESS AND IN-LINE HYDROFINISHING PROCESS

(75) Inventors: Darush Farshid, Larkspur, CA (US); Bruce Reynolds, Martinez, CA (US)

(73) Assignee: Chevron USA Inc., San Ramon, CA (US)

( * ) Notice: Subject to any disclaimer, the term of this patent is extended or adjusted under 35 U.S.C. 154(b) by 285 days.

(21) Appl. No.: 11/410,826

(22) Filed: Apr. 24, 2006

(65) Prior Publication Data

US 2007/0138059 A1 Jun. 21, 2007

Related U.S. Application Data

(63) Continuation-in-part of application No. 11/305,377, filed on Dec. 16, 2005, and a continuation-in-part of application No. 11/305,378, filed on Dec. 16, 2005, and a continuation-in-part of application No. 11/303,425, filed on Mar. 20, 2006.

(51) Int. Cl.
*C10G 45/04* (2006.01)

(52) U.S. Cl. ..... 208/78; 208/49; 208/58; 208/61; 208/66; 208/209; 208/211; 208/213; 208/216 R; 208/217

(58) Field of Classification Search ..... 208/78, 208/49, 58, 61, 66, 209, 211, 213, 216 R, 208/217

See application file for complete search history.

(56) References Cited

U.S. PATENT DOCUMENTS 4,684,456 A 8/1987 Van Driesen et al.
5,484,755 A * 1/1996 Lopez ..... 502/219
5,993,644 A 11/1999 Xiao et al.
6,190,542 B1 * 2/2001 Comolli et al. ..... 208/423
6,264,826 B1 7/2001 Xiao et al.
6,278,034 B1 * 8/2001 Espinoza et al. ..... 585/275
6,454,932 B1 9/2002 Baldassari et al.
6,554,994 B1 * 4/2003 Reynolds et al. ..... 208/211
6,630,066 B2 * 10/2003 Cash et al. ..... 208/58
6,660,157 B2 12/2003 Que et al.
6,726,832 B1 4/2004 Baldassari et al.
6,890,423 B2 5/2005 O'Rear

OTHER PUBLICATIONS

U.S. Appl. No. 10/938,202, filed Sep. 10, 2004, entitled "Highly Active Slurry Catalyst Composition", 14 pages.

(Continued)

*Primary Examiner*—Tam M Nguyen

(57) ABSTRACT

A new residuum full hydroconversion slurry reactor system has been developed that allows the catalyst, unconverted oil and converted oil to circulate in a continuous mixture throughout an entire reactor with no confinement of the mixture. The mixture is partially separated in between the reactors to remove only the converted oil while permitting the unconverted oil and the slurry catalyst to continue on into the next sequential reactor where a portion of the unconverted oil is converted to lower boiling point hydrocarbons, once again creating a mixture of unconverted oil, converted oil, and slurry catalyst. Further hydroprocessing may occur in additional reactors, fully converting the oil. The oil may alternately be partially converted, leaving a highly concentrated catalyst in unconverted oil which can be recycled directly to the first reactor. Fully converted oil is subsequently hydrofinished for the nearly complete removal of hetoroatoms such as sulfur and nitrogen.

19 Claims, 1 Drawing Sheet

OTHER PUBLICATIONS

U.S. Appl. No. 10/938,003, filed Sep. 10, 2004, entitled "Highly Active Slurry Catalyst Composition", 13 pages.

U.S. Appl. No. 10/938,438, filed Sep. 10, 2004, entitled "Process for Recycling an Active Slurry Catalyst Composition in Heavy Oil Upgrading", 15 pages.

U.S. Appl. No. 10/938,200, filed Sep. 10, 2004, entitled "Process for Upgrading Heavy Oil Using a Highly Active Slurry Catalyst Composition", 17 pages.

U.S. Appl. No. 10/938,269, filed Sep. 10, 2004, entitled "Process for Upgrading Heavy Oil Using a Highly Active Slurry Catalyst Compositon", 19 pages.

* cited by examiner

INTEGRATED HEAVY OIL UPGRADING PROCESS AND IN-LINE HYDROFINISHING PROCESS

This application is a Continuation-In-Part of co-pending application Ser. No. 11/305,377, Filed Dec. 16, 2005, Ser. No. 11/305,378, filed on Dec. 16, 2005, and Ser. No. 11/303,425, filed Mar. 20, 2006.

FIELD OF THE INVENTION

The instant invention relates to a process for upgrading heavy oils using a slurry catalyst composition, followed by hydrofinishing.

BACKGROUND OF THE INVENTION

There is an increased interest at this time in the processing of heavy oils, due to larger worldwide demand for petroleum products. Canada and Venezuela are sources of heavy oils. Processes which result in complete conversion of heavy oil feeds to useful products are of particular interest.

The following patents, which are incorporated by reference, are directed to the preparation of highly active slurry catalyst compositions and their use in processes for upgrading heavy oil:

U.S. Ser. No. 10/938,202 is directed to the preparation of a catalyst composition suitable for the hydroconversion of heavy oils. The catalyst composition is prepared by a series of steps, involving mixing a Group VIB metal oxide and aqueous ammonia to form an aqueous mixture, and sulfiding the mixture to form a slurry. The slurry is then promoted with a Group VIII metal. Subsequent steps involve mixing the slurry with a hydrocarbon oil and combining the resulting mixture with hydrogen gas and a second hydrocarbon oil having a lower viscosity than the first oil. An active catalyst composition is thereby formed.

U.S. Ser. No. 10/938,003 is directed to the preparation of a slurry catalyst composition. The slurry catalyst composition is prepared in a series of steps, involving mixing a Group VIB metal oxide and aqueous ammonia to form an aqueous mixture and sulfiding the mixture to form a slurry. The slurry is then promoted with a Group VIII metal. Subsequent steps involve mixing the slurry with a hydrocarbon oil, and combining the resulting mixture with hydrogen gas (under conditions which maintain the water in a liquid phase) to produce the active slurry catalyst.

U.S. Ser. No. 10/938,438 is directed to a process employing slurry catalyst compositions in the upgrading of heavy oils. The slurry catalyst composition is not permitted to settle, which would result in possible deactivation. The slurry is recycled to an upgrading reactor for repeated use and products require no further separation procedures for catalyst removal.

U.S. Ser. No. 10/938,200 is directed to a process for upgrading heavy oils using a slurry composition. The slurry composition is prepared in a series of steps, involving mixing a Group VIB metal oxide with aqueous ammonia to form an aqueous mixture and sulfiding the mixture to form a slurry. The slurry is then promoted with a Group VIII metal compound. Subsequent steps involve mixing the slurry with a hydrocarbon oil, and combining the resulting mixture with hydrogen gas (under conditions which maintain the water in a liquid phase) to produce the active slurry catalyst.

U.S. Ser. No. 10/938,269 is directed to a process for upgrading heavy oils using a slurry composition. The slurry composition is prepared by a series of steps, involving mixing a Group VIB metal oxide and aqueous ammonia to form an aqueous mixture, and sulfiding the mixture to form a slurry. The slurry is then promoted with a Group VIII metal. Subsequent steps involve mixing the slurry with a hydrocarbon oil and combining the resulting mixture with hydrogen gas and a second hydrocarbon oil having a lower viscosity than the first oil. An active catalyst composition is thereby formed.

SUMMARY OF THE INVENTION

A process for the hydroconversion of heavy oils with a slurry which results in almost complete removal of sulfur or nitrogen from the final product, said process employing at least two upflow reactors in series with a separator optionally located in between each reactor, said process comprising the following steps:

(a) combining a heated heavy oil feed, an active slurry catalyst composition and a hydrogen-containing gas to form a mixture;

(b) passing the mixture of step (a) to the bottom of the first reactor, which is maintained at slurry hydroconversion conditions, including elevated temperature and pressure;

(c) removing a vapor mixture containing product, gases, unconverted material and slurry catalyst from the top of the first reactor and passing it to a first separator;

(d) in the first separator, removing a vapor stream comprising product and gases overhead to a lean oil contactor and passing a liquid bottoms material, comprising unconverted material and slurry catalyst, to the bottom of the second reactor, which is maintained at hydroconversion conditions, including elevated temperature and pressure;

(e) removing a vapor mixture containing product, gases, unconverted material and slurry catalyst from the top of the second reactor and passing it to a second separator;

(f) in the second separator, removing a vapor stream comprising product and gases overhead to the lean oil contactor and passing a liquid bottoms material, comprising unconverted material and slurry catalyst to further processing;

(g) contacting the stream comprising product and gases countercurrently with lean oil in a lean oil contactor wherein entrained catalyst and any unconverted material is removed by contact with a lean oil which exits as bottoms while products and gases are passed overhead;

(h) passing the overhead material of step (g) to a hydroprocessing unit for the removal of sulfur and nitrogen.

The slurry upgrading process of this invention converts nearly 98% of vacuum residue to lighter products (in the boiling range below 1000 F). Some of these products require further processing due to their high nitrogen, high sulfur and high aromatics content, as well as low API. The instant invention employs hydrofinishing downstream of the slurry upgrading process, resulting in almost complete removal of sulfur and nitrogen from the final product.

BRIEF DESCRIPTION OF THE FIGURE

The FIGURE depicts a process scheme of this invention which employs three reactors, followed by a hydrofinishing reactor.

DETAILED DESCRIPTION OF THE INVENTION

Figure 1:
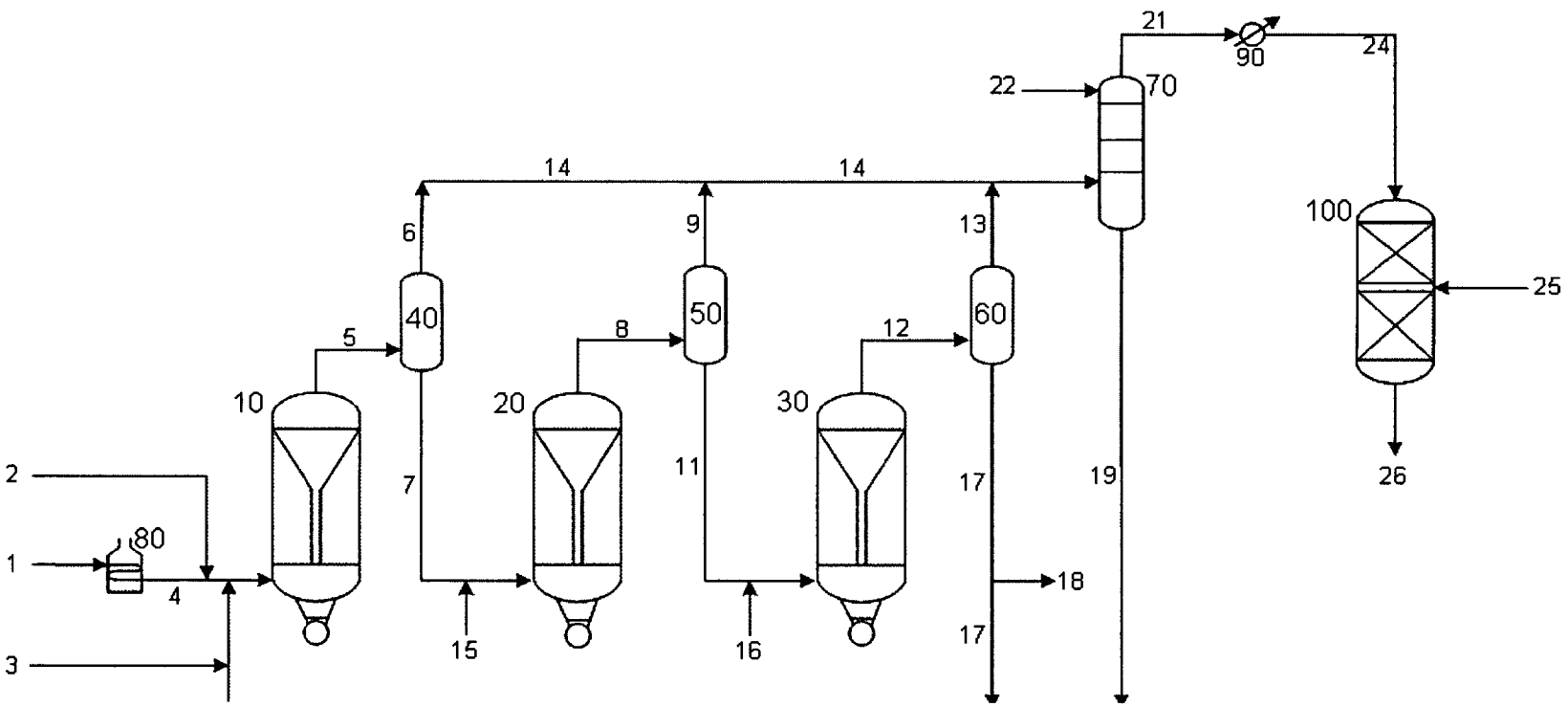

The instant invention is directed to a process for catalyst activated slurry hydrocracking, as depicted in the Figure. Stream 1 comprises a heavy feed, such as vacuum residuum. This feed enters furnace 80 where it is heated, exiting in stream 4. Stream 4 combines with a hydrogen containing gas(stream 2), and a stream comprising an active slurry composition(stream 23), resulting in a mixture(stream 24). Stream 24 enters the bottom of the first reactor 10. Vapor stream 5 exits the top of the reactor and comprises products, gases, slurry, and unconverted material. Stream 5 passes to hot high pressure separator 40, which is preferably a flash drum. A vapor stream comprising products and gases is removed overhead as stream 6. Stream 6 is passed to a lean oil contactor for further processing. Liquid stream 7 is removed through the bottom of the separator 40. Stream 7 contains slurry in combination with unconverted oil.

Stream 7 is combined with a gaseous stream comprising hydrogen (steam 15) to create stream 25. Stream 25 enters the bottom of second reactor 20. Vapor stream 8, comprising products, gases, slurry and unconverted material, exits the second reactor overhead and passes to separator 50, which is preferably a flash drum. Products and gases are removed overhead as stream 9 and passed to the lean oil contactor for further processing. Liquid stream 11 is removed through the bottom of the flash drum. Stream 11 contains slurry in combination with unconverted oil.

Stream 11 is combined with a gaseous stream comprising hydrogen (steam 16) to create stream 26. Stream 26 enters the bottom of third reactor 30. Stream 12, which exits third reactor 30 passes to separator 60, preferably a flash drum. Product and gases are removed overhead from separator 60 as stream 13. Liquid stream 17 is removed through the bottom of the separator 60. Stream 17 comprises slurry in combination with unconverted oil. A portion of this stream may be drawn off through stream 18.

Overhead vapor streams 6, 9 and 13 create stream 14, which passes to lean oil contactor 70. Stream 22, containing a lean oil such as vacuum gas oil, enters the top portion of lean oil contactor 70 and flows downward. (1) removing any possible entrained catalyst and (2) reducing heavy materials(high boiling range oil including small amounts of vacuum residue). Products and gases (vapor stream 21) exit lean oil contactor 70 overhead, while liquid stream 19 exits at the bottom. Stream 19 comprises a mixture of slurry and unconverted oil. Stream 19 is combined with stream 17, which also comprises a mixture of slurry and unconverted oil. Fresh slurry is added in stream 3, and stream 23 is created. Stream 23 is combined with the feed to first reactor 10.

Stream 21 enters steam exchanger (or generator) 90, for cooling prior to hydrofinishing. The purpose of the steam exchanger is to control the hydrofinisher reactor inlet temperature as needed. Stream 21 enters the top bed of the hydrofinisher 100, a fixed bed reactor, preferably having multiple beds of active hydrotreating catalyst. Hydrogen (stream 27) is inserted as interbed quench if multiple beds are used. Hydrofinished product is removed as stream 28.

The hydrofinishing unit further refines products from the slurry upgrader to high quality products by removing impurities and stabilizing the products by saturation. Greater than 99 wt % sulfur and nitrogen removal may be achieved. Reactor effluent is cooled by means of heat recovery and sent to the product recovery section as in any conventional hydroprocessing unit. Conditions for hydrofinishing hydrocarbons are well known to those of skill in the art, Typical conditions are between 400 and 800 F, 0.1 to 3 LHSV, and 200 to 3000 psig. Catalysts useful for the hydrofinishing reaction are preferably combinations of nickel, cobalt and molybdenum supported on zeolites or amorphous material.

Alternate embodiments, not pictured, include a series of reactors in which one or more of the reactors contains internal separation means, rather than an external separator or flash drum following the reactor. In another embodiment, there is no interstage separation between one or more of the reactors in series.

The process for the preparation of the catalyst slurry composition used in this invention is set forth in U.S. Ser. No. 10/938,003 and U.S. Ser. No. 10/938,202 and is incorporated by reference. In one embodiment, the slurry catalyst composition is formed from the combination of a slurry comprising Group VIB and Group VIII metals and a hydrocarbon oil having a viscosity of at least 2 cSt (or 32.8 SSU) @212° F., forming an active catalyst composition admixed with the hydrocarbon oil. The preferred viscosity range for the hydrocarbon oil is from at least about 2 cSt (or 32.8 SSU) @212° F. to 15 cSt (or 77.9 SSU) @212° F. The catalyst composition is useful for upgrading carbonaceous feedstocks which include atmospheric gas oils, vacuum gas oils, deasphalted oils, olefins, oils derived from tar sands or bitumen, oils derived from coal, heavy crude oils, synthetic oils from Fischer-Tropsch processes, and oils derived from recycled oil wastes and polymers. The catalyst composition is useful for but not limited to hydrogenation upgrading processes such as thermal hydrocracking, hydrotreating, hydrodesulfurization, hydrodenitrogenation, and hydrodemetalization.

The feeds suitable for use in this invention are set forth in U.S. Ser. No. 10/938,269 and include atmospheric residuum, vacuum residuum,tar from a solvent deasphalting unit, atmospheric gas oils, vacuum gas oils, deasphalted oils, olefins, oils derived from tar sands or bitumen, oils derived from coal, heavy crude oils, synthetic oils from Fischer-Tropsch processes, and oils derived from recycled oil wastes and polymers. Suitable feeds also include atmospheric residuum, vacuum residuum and tar from a solvent deasphlating unit.

The preferred type of reactor in the instant invention is a liquid recirculating reactor, although other types of upflow reactors may be employed. Liquid recirculating reactors are discussed further in copending application Ser. No. 11/305,359 or US Patent Publication No. US2007140927 (T6493) which is incorporated by reference.

A liquid recirculation reactor is an upflow reactor to which is fed heavy hydrocarbon oil admixed with slurry catalyst and a hydrogen rich gas at elevated pressure and temperature, for hydroconversion.

Hydroconversion includes processes such as hydrocracking and the removal of heteroatom contaminants (such sulfur and nitrogen). In slurry catalyst use, catalyst particles are extremely small (1-10 micron). Pumps are not generally needed for recirculation, although they may be used. Sufficient motion of the catalyst is usually established without them.

EXAMPLE

In-line Hydrofinishing Performance

| | Feed from slurry hydrocracker to Hydrofinisher | Full Range Product from Hydro-finisher | Jet Fuel Cut from Hydro-finisher | Diesel Cut from Hydrofinisher |
|---|---|---|---|---|
| API | 34.8 | 38.9 | | |
| Sulfur, wppm | 3300 | 6 | <2 | 3 |
| Nitrogen, wppm | 2500 | 23 | 6 | 8 |
| Smoke Point, mm | | | 19 | |
| Cetane Index | | | | 44 |

It is apparent from the Table above that hydrofinishing of the product of slurry hydrocracking provides dramatic reduction of sulfur and nitrogen content. In both full range product and in individual product cuts, such as jet fuel and diesel.

What is claimed is:

1. A process for the hydroconversion of heavy oils with an active slurry catalyst composition admixed in a hydrocarbon oil, which results in almost complete removal of sulfur or nitrogen from the final product, said process employing at least two upflow reactors in series with a separator located in between each reactor, said process comprising the following steps:

(a) providing the active slurry catalyst composition admixed in a hydrocarbon oil, formed by combining a slurry comprising Group VIB and Group VIII metals and a hydrocarbon oil having a viscosity of at least 2 cSt (or 32.8 SSU) @212° F.;

(b) combining a heated heavy oil feed, the active slurry catalyst composition admixed in the hydrocarbon oil and a hydrogen-containing gas to form a mixture;

(c) passing the mixture of step (b) to the bottom of the first reactor, which is maintained at slurry hydroconversion conditions, including elevated temperature and pressure;

(d) removing a vapor mixture containing product, gases, unconverted material and slurry catalyst from the top of the first reactor and passing it to a first separator;

(e) in the first separator, removing a vapor stream comprising product and gases overhead to a lean oil contactor and passing a liquid bottoms material, comprising unconverted material and slurry catalyst, to the bottom of the second reactor, which is maintained at hydroconversion conditions, including elevated temperature and pressure;

(f) removing a vapor mixture containing product, gases, unconverted material and slurry catalyst from the top of the second reactor and passing it to a second separator;

(g) in the second separator, removing a vapor stream comprising product and gases overhead to the lean oil contactor and passing a liquid bottoms material, comprising unconverted material and slurry catalyst to further processing;

(h) contacting the vapor stream comprising product and gases countercurrently with lean oil in a lean oil contactor wherein entrained catalyst and any unconverted material is removed by contact with a lean oil which exits as bottoms while products and gases are passed overhead;

(i) passing the overhead material of step (h) to a hydroprocessing unit for the removal of sulfur and nitrogen, wherein greater than 99% sulfur and nitrogen removal and 98% conversion to lighter products is achieved; hydroprocessing conditions employed in each reactor comprise a total pressure in the range from 1500 through 3500 psia and temperature from 700 through 900 F; and hydrofinishing conditions in the hydroprocessing unit comprise temperatures in the range from 400 and 800 F, space velocities in the range from 0.1 to 3 LHSV, and pressures in the range from 200 to 3000 psig wherein the active slurry catalyst composition is formed by the following steps:

(a) mixing a Group VIB metal oxide and aqueous ammonia to form a Group VIB metal compound aqueous mixture;

(b) sulfiding, in an initial reaction zone, the aqueous mixture of step (a) with a gas comprising hydrogen sulfide to a dosage greater than 8 SCF of hydrogen sulfide per pound of Group VIB metal to form a slurry;

(c) promoting the slurry with a Group VIII metal compound;

(d) mixing the slurry of step (c) with hydrocarbon oil having a viscosity of at least 2 cSt 212° F. to form an intermediate mixture;

(e) combining the intermediate mixture with hydrogen gas in a second reaction zone, ruder conditions which maintain the water in the intermediate mixture in a liquid phase, thereby forming an active catalyst composition admixed with a liquid hydrocarbon; and (f) recovering the active catalyst composition.

2. The process of claim 1, wherein the hydroprocessing unit is operated at hydrofinishing conditions.

3. The process of claim 1, wherein the hydroprocessing unit is a fixed bed reactor which comprises at least one catalyst bed.

4. The process of claim 3, wherein quench gas is introduced between beds to control bed inlet temperatures.

5. The process of claim 3, wherein at least one catalyst bed of the hydroprocessing unit comprises hydrofinishing catalyst.

6. The process of claim 5, wherein hydrofinishing catalyst comprises combinations selected from the group consisting of cobalt, nickel and molybdenum, on a zeolitic or amorphous support.

7. The process of claim 1, wherein the inlet temperature to the hydroprocessing unit is controlled.

8. The process of claim 7, wherein a steam exchanger is employed to control the inlet temperature of the hydroprocessing unit.

9. The process of claim 1, wherein the bottoms material of step (g) is recycled to step (b), the mixture of step (b) further comprising recycled unconverted material and slurry catalyst.

10. The process of claim 1, wherein the bottoms material of step (g) is passed to the bottom of a third reactor which is maintained at hydroconversion conditions, including elevated temperature and pressure.

11. The process of claim 1, in which at least one of the reactors is a liquid recirculating reactor.

12. The process of claim 10, in which the recirculating reactor employs a pump.

13. The process of claim 1, in which the total pressure is in the range from 2000 through 3000 psia and temperature is preferably in the range from 775 through 850 F.

14. The process of claim 1, wherein the separator located between each reactor is a flash drum.

15. The hydroconversion process of claim 1, wherein the heavy oil is selected from the group consisting of atmospheric residuum, vacuum residuum, tar from a solvent deasphlating unit, atmospheric gas oils, vacuum gas oils, deasphalted oils, olefins, oils derived from tar sands or bitumen, oils derived from coal, heavy crude oils, synthetic oils from Fischer-Tropsch processes, and oils derived from recycled oil wastes and polymers.

16. The hydroconversion process of claim 1, wherein the process is selected from the group consisting of hydrocracking, hydrotreating, hydrodesulphurization, hydrodenitrification, and hydrodemetalization.

17. A process for the hydroconversion of heavy oils with an active slurry catalyst composition admixed in a hydrocarbon oil, said process resulting in almost complete removal of sulfur or nitrogen from the final product, wherein at least two upflow reactors in series are employed with a separator located internally in both reactors, said process comprising the following steps:

(a) providing the active slurry catalyst composition admixed in a hydrocarbon oil, formed by combining a slurry comprising Group VIB and Group VIII metals and a hydrocarbon oil having a viscosity of at least 2 cSt (or 32.8 SSU) @212° F.;

(b) combining a heated heavy oil feed, the active slurry catalyst composition admixed in the hydrocarbon oil and a hydrogen-containing gas to form a mixture;

(c) passing the mixture of step (a) to the bottom of the first reactor, which is maintained at hydroprocessing conditions, including elevated temperature and pressure;

(d) separating internally in the first reactor a stream comprising product, gases, unconverted material and slurry catalyst into two streams, a vapor stream comprising products, hydrogen and other gases, and a liquid stream comprising unconverted material and slurry catalyst;

(e) passing the vapor stream of step (d) overhead to a lean oil contactor, and passing the liquid stream, comprising unconverted material and slurry catalyst, from the first reactor as a bottoms stream;

(f) combining the bottoms stream of step (e) with additional feed oil resulting in an intermediate mixture;

(g) passing the intermediate mixture of step (f) to the bottom of the second reactor, which is maintained at hydroprocessing conditions, including elevated temperature and pressure;

(h) separating internally in the second reactor a stream comprising product, gases unconverted material and slurry catalyst into two streams, a vapor stream comprising products, hydrogen and other gases, and a liquid stream comprising unconverted material and slurry catalyst;

(i) passing the vapor stream of step (h) overhead to a lean oil contactor, and passing the liquid stream of step (h) from the second reactor as a bottoms stream for further processing; and j) passing the overhead effluent of the lean oil contactor of step (i) to a hydroprocessing unit for the removal of sulfur and nitrogen;

wherein greater than 99% sulfur and nitrogen removal and 98% conversion to lighter products is achieved wherein the active slurry catalyst composition is formed by the following steps:

(a) mixing a Group VIB metal oxide and aqueous ammonia to form a Group VIB metal compound aqueous mixture;

(b) sulfiding, in an initial reaction zone, the aqueous mixture of step (a) with a gas comprising hydrogen sulfide to a dosage greater than 8 SCF of hydrogen sulfide per pound of Group VIB metal to form a slurry;

(c) promoting the slurry with a Group VIII metal compound;

(d) mixing the slurry of step (c) with hydrocarbon oil having a viscosity of at least 2 cSt 212° F. to form an intermediate mixture;

(e) combining the intermediate mixture with hydrogen gas in a second reaction zone, ruder conditions which maintain the water in the intermediate mixture in a liquid phase, thereby forming an active catalyst composition admixed with a liquid hydrocarbon; and (f) recovering the active catalyst composition.

18. A process for the hydroconversion of heavy oils employing an active slurry catalyst composition, said process employing at least two upflow reactors in series with no interstage separation, said process comprising the following steps:

(a) providing the active slurry catalyst composition, formed from combining a slurry comprising Group VIB and Group VIII metals and a hydrocarbon oil having a viscosity of at least 2 cSt (or 32.8 SSU) @212° F.

(b) combining a heated heavy oil feed, the active slurry catalyst composition and a hydrogen-containing gas to form a mixture;

(c) passing the mixture of step (b) to the bottom of the first reactor, which is maintained at hydroprocessing conditions, including elevated temperature and pressure;

(d) passing from the first reactor, a stream comprising product and gases, unconverted material and slurry catalyst to a second reactor maintained at hydroprocessing conditions for further processing and subsequent separation into vapor and liquid streams, with hydroprocessing of the vapor stream comprising product for removal of sulfur and nitrogen;

wherein greater than 99%sulfur and nitrogen removal and 9800%conversion to lighter products is achieved wherein the active slurry catalyst composition is formed by the following steps:

(a) mixing a Group VIB metal oxide and aqueous ammonia to form a Group VIB metal compound aqueous mixture;

(b) sulfiding, in an initial reaction zone, the aqueous mixture of step (a) with a gas comprising hydrogen sulfide to a dosage greater than 8 SCF of hydrogen sulfide per pound of Group VIB metal to form a slurry;

(c) promoting the slurry with a Group VIII metal compound;

(d) mixing the slurry of step (c) with hydrocarbon oil having a viscosity of at least 2 cSt 212° F. to form an intermediate mixture;

(e) combining the intermediate mixture with hydrogen gas in a second reaction zone, ruder conditions which maintain the water in the intermediate mixture in a liquid phase, thereby forming an active catalyst composition admixed with a liquid hydrocarbon; and (f) recovering the active catalyst composition.

19. The process of claim 18, in which additional hydrogen is added to the stream of step (d) prior to its entrance to the second reactor.

* * * * *